US009640097B2

(12) United States Patent
Cai

(10) Patent No.: US 9,640,097 B2
(45) Date of Patent: May 2, 2017

(54) OLED PIXEL DRIVING CIRCUIT, ELECTROSTATIC DISCHARGE PROTECTION CIRCUIT AND DETECTION METHOD

(71) Applicants: Shanghai Tianma AM-OLED Co., Ltd, Shanghai (CN); Tianma Micro-Electronics Co., Ltd., Shenzhen (CN)

(72) Inventor: Tao Cai, Shanghai (CN)

(73) Assignees: SHANGHAI TIANMA AM-OLED CO., LTD., Shanghai (CN); TIANMA MICRO-ELECTRONICS CO., LTD., Shenzhen (CN)

( * ) Notice: Subject to any disclaimer, the term of this patent is extended or adjusted under 35 U.S.C. 154(b) by 277 days.

(21) Appl. No.: 14/538,773

(22) Filed: Nov. 11, 2014

(65) Prior Publication Data

US 2015/0379927 A1 Dec. 31, 2015

(30) Foreign Application Priority Data

Jun. 30, 2014 (CN) ..... 2014 1 0306880

(51) Int. Cl.

| | |
|---|---|
| ***G09G 3/32*** | (2016.01) |
| ***G09G 3/00*** | (2006.01) |
| ***G09G 3/3233*** | (2016.01) |

(52) U.S. Cl.

CPC ..... *G09G 3/006* (2013.01); *G09G 3/3233* (2013.01); *G09G 2330/08* (2013.01); *G09G 2330/10* (2013.01); *G09G 2330/12* (2013.01)

(58) Field of Classification Search

CPC .. G09G 3/006; G09G 3/3233; G09G 2330/08; G09G 2330/10; G09G 2330/12

See application file for complete search history.

(56) References Cited

U.S. PATENT DOCUMENTS

| | | | | |
|---|---|---|---|---|
| 5,936,687 | A * | 8/1999 | Lee | G02F 1/136204 345/69 |
| 8,248,356 | B2 * | 8/2012 | Chen | G09G 3/006 345/100 |
| 8,314,756 | B2 | 11/2012 | Rankov et al. | |
| 2002/0140644 | A1 | 10/2002 | Sato et al. | |
| 2010/0066383 | A1 * | 3/2010 | Chung | G02F 1/1309 324/512 |

(Continued)

FOREIGN PATENT DOCUMENTS

| | | |
|---|---|---|
| CN | 200941110 Y | 8/2007 |
| CN | 101364022 A | 2/2009 |

(Continued)

OTHER PUBLICATIONS

1st Office Action as issued in corresponding Chinese Application No. 201410306880.5, dated Oct. 30. 2015 and accompanying English-language summary.

*Primary Examiner* — Amr Awad
*Assistant Examiner* — Stephen Bray
(74) *Attorney, Agent, or Firm* — Anova Law Group, PLLC

(57) ABSTRACT

An OLED pixel driving circuit is disclosed. The pixel driving circuit includes a plurality of interlaced scanning and data lines, and a first defect detection unit electrically connected to a first endpoint of at least one of the scanning lines, and the data lines. The first endpoint is located at one end of the at least one scanning line or data line.

12 Claims, 5 Drawing Sheets

(56) References Cited

U.S. PATENT DOCUMENTS

| | | | | |
|---|---|---|---|---|
| 2010/0155724 | A1 | 6/2010 | Hong et al. | |
| 2013/0120228 | A1 | 5/2013 | Yoon | |
| 2013/0141314 | A1* | 6/2013 | Ka | G09G 3/006 345/55 |
| 2016/0098953 | A1* | 4/2016 | Ko | G09G 3/3208 345/76 |
| 2016/0240120 | A1* | 8/2016 | Du | G09G 3/006 |

FOREIGN PATENT DOCUMENTS

| | | | |
|---|---|---|---|
| CN | 101763817 | A | 6/2010 |
| CN | 103185845 | A | 7/2013 |
| CN | 103295530 | A | 9/2013 |

* cited by examiner

OLED PIXEL DRIVING CIRCUIT, ELECTROSTATIC DISCHARGE PROTECTION CIRCUIT AND DETECTION METHOD

CROSS REFERENCE TO RELATED APPLICATIONS

This application claims the benefit of priority to Chinese Patent Application No. 201410306880.5, filed with the Chinese Patent Office on Jun. 30, 2014 and entitled "OLED PIXEL DRIVING CIRCUIT, ELECTROSTATIC DISCHARGE PROTECTION CIRCUIT AND DETECTION METHOD" and filed with the State Intellectual Property Office on, which is incorporated herein by reference in its entirety.

BACKGROUND OF THE INVENTION

The OLED (Organic Light-Emitting Display) is an all solid-state device which converts electrical energy into light energy directly, and the OLED, considered as a new generation of display device, has attracted people's great attention due to advantages thereof such as thin and light, a high contrast, a rapid response, a wide view and a wide range of working temperature. In order to achieve large-scale industrialization of the OLED, it is necessary to improve light-emitting efficiency and stability of the device, and design an effective image display driving circuit.

An OLED product is different from a generic product in that a circuit constitution of a display region is complex, a structure of the simplest pixel circuit is 2T1C structure, and a structure of a complex circuit may reach 6T2C or more, however, if the OLED product fails, similar failure phenomena are mostly reflected, such as a bright spot, a dark spot, a bright line or a dark line, and a failure analysis for a product defect is very difficult.

In sum, for a staff analyzing a line defect of the OLED display, since a reason for the line defect is in various forms, how to determine the reason rapidly is a very difficult job, and it is difficult to look for a corresponding defect position.

BRIEF SUMMARY OF THE INVENTION

One inventive aspect is an OLED pixel driving circuit. The pixel driving circuit includes a plurality of interlaced scanning and data lines, and a first defect detection unit electrically connected to a first endpoint of at least one of the scanning lines, and the data lines. The first endpoint is located at one end of the at least one scanning line or data line.

Another inventive aspect is an electrostatic discharge protection circuit located in a non-display region of a display panel. The electrostatic discharge protection circuit includes an electrostatic discharge unit configured to receive a voltage from a scanning line or a data line of a pixel driving circuit of the display panel and to provide an electrostatic protection. The electrostatic discharge protection circuit also includes a power supply line, a switch transistor, and a second defect detection unit, where the second defect detection unit is connected to a gate of the switch transistor through the power supply line. In addition, the defect detection unit is connected to a first electrode of the switch transistor, and a second electrode of the switch transistor is connected to the data line of the pixel driving circuit.

Another inventive aspect is a display panel. The display panel includes a scanning driver connected to a plurality of scanning lines at second endpoints of the scanning lines and configured to provide a scanning signal to the scanning lines. The display panel also includes a data driver connected to a plurality of data lines at second endpoints of the data lines and configured to provide a data signal to the data lines. The display panel also includes a plurality of pixel driving circuits arranged in a matrix, where the second endpoint of each data line or scanning line is located at one end of the data line or the scanning line. The pixel driving circuits each includes a first defect detection unit electrically connected to a first endpoint of at least one of the scanning lines, and the data lines, and where the first endpoint is located at another end of the at least one scanning line or data line.

Another inventive aspect is a method of detecting a defect in a display panel. The display panel includes a scanning driver connected to a plurality of scanning lines at second endpoints of the scanning lines and configured to provide a scanning signal to the scanning lines. The display panel also includes a data driver connected to a plurality of data lines at second endpoints of the data lines and configured to provide a data signal to the data lines, and a plurality of pixel driving circuits arranged in a matrix. The second endpoint of each data line or scanning line is located at one end of the data line or the scanning line. The pixel driving circuits each includes a first defect detection unit electrically connected to a first endpoint of at least one of the scanning lines, and the data lines. In addition, the first endpoint is located at another end of the at least one scanning line or data line. The method includes providing an optical detection device and at least one of: a) sending, by a scanning line, a detection signal to a defect detection unit corresponding to rows, and b) sending, by a data line, a detection signal to a defect detection unit corresponding to columns, where the defect detection unit includes an organic light-emitting diode. The method also includes detecting, by the optical detection device, whether luminous intensity of the organic light-emitting diode corresponding to the data line and/or the scanning line of a pixel driving circuit reaches a valid predetermined value, and determining that the data line or the scanning line corresponding to the organic light-emitting diode has a defect in response to the organic light-emitting diode having a luminous intensity less than the predetermined value.

DETAILED DESCRIPTION OF THE PREFERRED EMBODIMENTS

The technical solution of the disclosure is further illustrated below in conjunction with drawings and through specific embodiments. It should be understood that the specific embodiments described here are just for explaining the disclosure and not intended to limit the disclosure. In addition, it is required to be illustrated that the drawings show only content of a part relating to the disclosure and not whole content for ease of description.

An Embodiment

Figure 1:
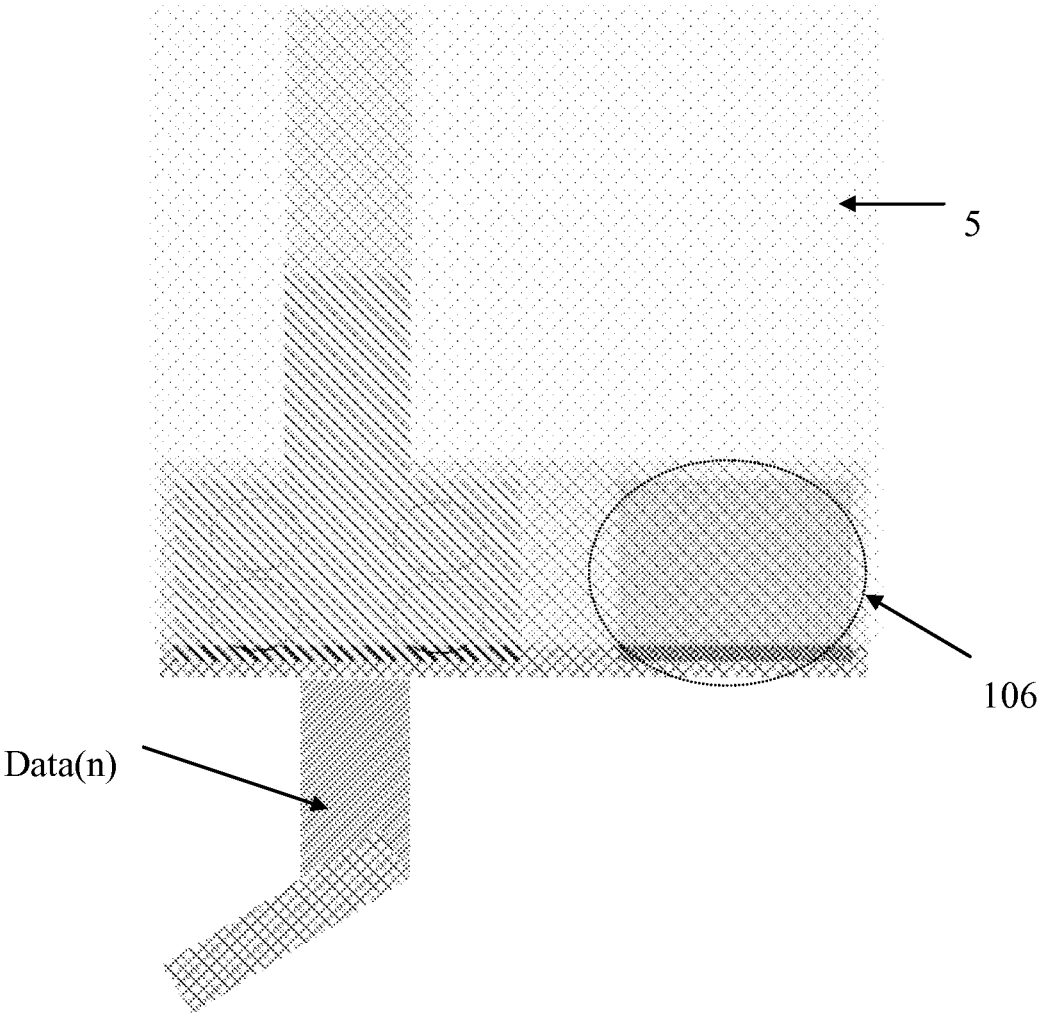
FIG. 1 is a diagram of a pixel structure according to an embodiment of the invention.
Figure 2:
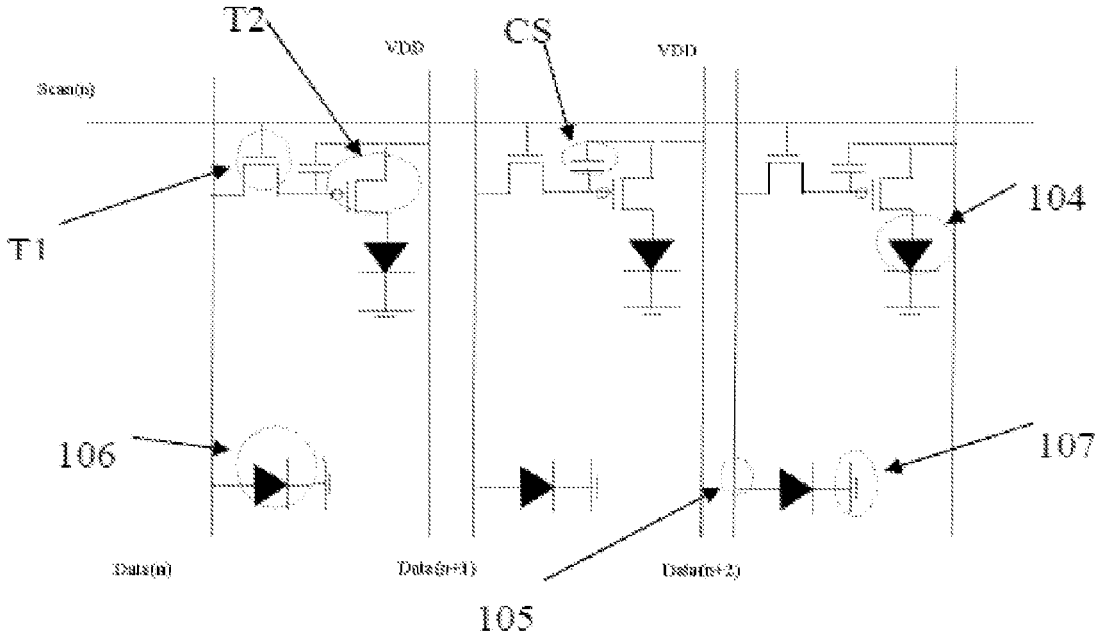
FIG. 2 is a diagram of a pixel circuit according to an embodiment of the invention.

As shown in FIG. 1 and FIG. 2 which is a schematic structural diagram of a pixel circuit according to an embodiment of the invention, an OLED pixel circuit includes multiple scanning lines Scan (only Scan(n) is shown in the Figures) and multiple data lines Data (only Data(n), Data (n+1), Data(n+2) are shown in the Figures) in an interlaced arrangement; pixel regions are formed by regions surrounded by intersections of data lines with scanning lines, where each pixel region includes a 2T1C pixel circuit, specifically, each pixel circuit includes a first transistor T1, a second transistor T2 and a light-emitting diode 104, a gate of the first transistor T1 is electrically connected to the scanning line Scan(n) (n is a natural number), a first electrode of the first transistor T1 is electrically connected to the data line Data(n), and a second electrode of the first transistor T1 is connected to a gate of the second transistor T2; a first electrode of the second transistor is connected to a data line Data(n+1), a second electrode of the second transistor is electrically connected to one end of the light-emitting diode 104, another end of the light-emitting diode 104 is connected to a common ground terminal 107, and a capacitor CS is connected between the first transistor and the second transistor.

Specifically, the operation principle is as follows: in a case that a scanning line is selected, the transistor T1 is turned on, and the storage capacitor CS is charged by a data voltage via the transistor T1, the storage capacitor CS provides a drain current to the transistor T2; and in a case that the scanning line Scan(n) is not selected, the transistor T1 is cut off, charges stored in the storage capacitor CS continue maintaining a gate voltage of the transistor T2, and the transistor T2 is maintained in an on condition, therefore, the OLED is controlled by a constant current in a whole frame period, the current of the OLED can be maintained to be constant during time of one screen. It is different from TFT-LCD in which the brightness is controlled by a steady voltage that the OLED device is driven by the current and requires a steady current to control light emission.

Further, the embodiment of the invention further includes a defect detection unit particularly an organic light-emitting diode 106, which is disposed at a first endpoint 105 of the data line Data(n) and is electrically connected to the data line Data(n), the first endpoint 105 is located at one end of a whole data line Data(n), and in a preferred embodiment in FIG. 2, the organic light-emitting diode 106 is disposed at a first endpoint 105 of each data line, another end of each organic light-emitting diode 106 is connected to the common ground terminal 107.

The defect detection unit is disposed as above, when a defect is analyzed, it is only required to provide a positive voltage to the data line, an organic light-emitting diode corresponding to the data line that is normal and is not scratched will emit light, and an organic light-emitting diode corresponding to the data line that is broke or having micro-short circuiting does not emit light or emit weak light since the voltage can not be provided to the data line. In this case, it is easy to distinguish the reason that a defect product is generated, from an abnormality at an upper display region or an abnormality at a lower stretched line. Specifically, the defect detection method includes: providing an optical detection device at first; sending, by the data line, a detection signal to a defect detection unit corresponding to rows, where the defect detection unit may be an organic light-emitting diode; detecting, by the optical detection apparatus, whether luminous intensity of the organic light-emitting diode corresponding to the data line of the pixel driving circuit reaches a valid predetermined value, where the predetermined value may be set as 4000 candelas, and determining that the data line or a scanning line corresponding to the organic light-emitting diode has a defect in a case that the organic light-emitting diode does not emit light or the luminous intensity is lower than the predetermined value. In the embodiment, detection time lasts no more than 60 seconds after the detection begins, and the predetermined value of the luminous intensity and the detection time may also be adjusted based on an actual product and a circuit structure.

Figure 3:
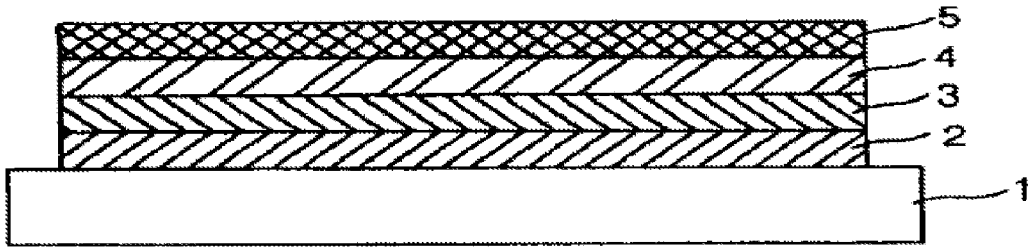
FIG. 3 is a layered structural diagram of an organic light-emitting diode according to an embodiment of the invention.

Furthermore, the embodiment of the invention further provides a method for manufacturing an organic light-emitting diode. With reference to FIG. 1 and FIG. 3, the organic light-emitting diode includes: an anode 2 in the same layer as the stretched line metal in the data line and disposed on a substrate 1, where the anode 2 may be made of a metal material; a hole injection layer 3 on the anode 2; a light-emitting layer 4 made of an organic material; and a cathode 5 covering the light-emitting layer which is finally fabricated, where the cathode 5 may be made of a metal having a low power consumption, and the cathode of the organic light-emitting diode is connected to the common ground terminal. In a case that an electrical field is applied between the anode 2 and the cathode 5, holes in the hole injection layer 3 and electrons in the metal enter into the light-emitting layer 4, and are recombined with each other in the light-emitting layer 4, then an organic material (fluorescence and phosphorescence) in the light-emitting layer 4 is excited and transited to generate visible light. In this case, the brightness of the organic light-emitting diode is in direct proportion to a current between the anode and the cathode.

The structure of the pixel circuit and the structure of the organic light-emitting diode described above are just examples, a structure of a pixel circuit having multiple transistors and multiple capacitors in the art may also be suitable for the structure of the disclosure, and this also applies to the organic light-emitting diode. Only a simpler structure is recited in the embodiment of the invention, other structure of the organic light-emitting diode may also be applied to the disclosure.

An Embodiment

Figure 4:
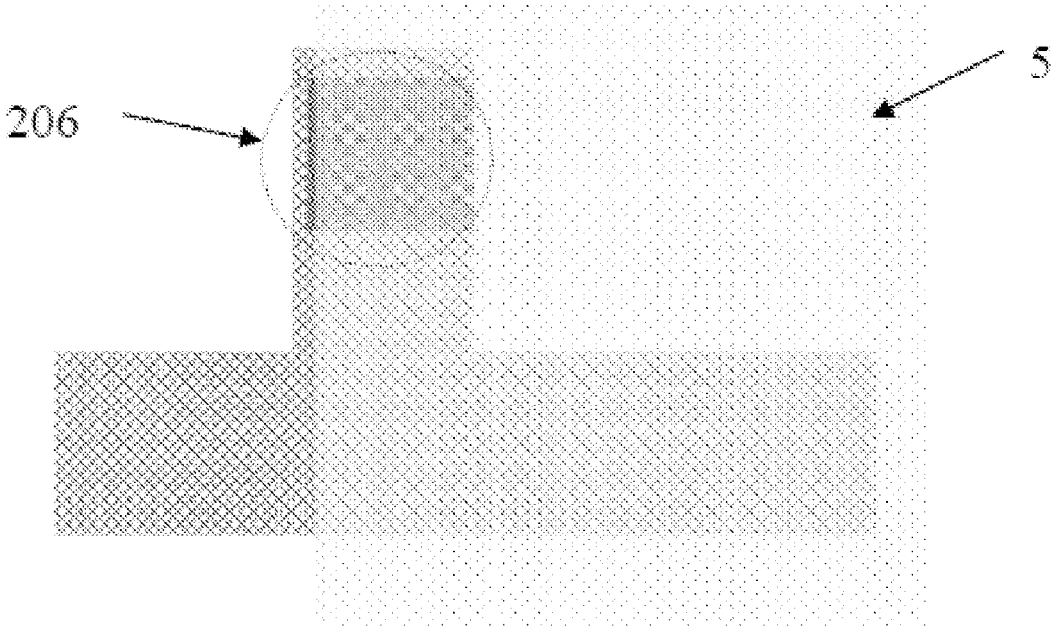
FIG. 4 is a diagram of a pixel structure according to another embodiment of the invention.
Figure 5:
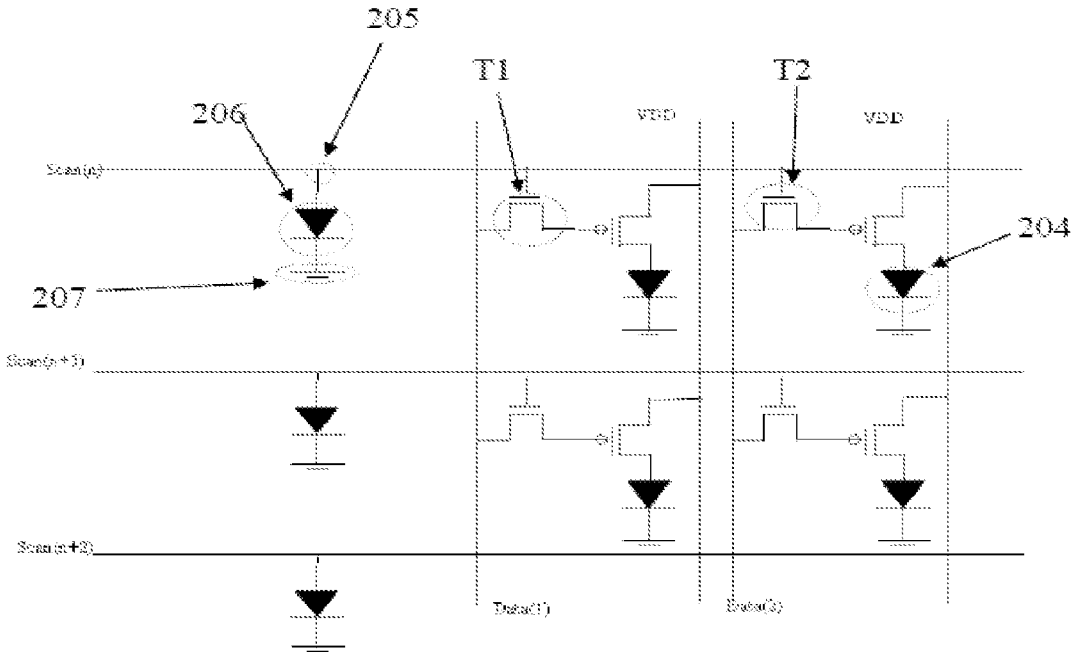
FIG. 5 is a diagram of a pixel circuit according to another embodiment of the invention.

As shown in FIG. 4 and FIG. 5 which is a schematic structural diagram of a pixel circuit according to another embodiment of the invention, an OLED pixel circuit includes multiple scanning lines Scan (only Scan(n),Scan (n+1) and Scan(n+2) are shown in the figures) and multiple data lines Data (only Data(1) and Data(2) are shown in the figures) in an interlaced arrangement; pixel regions are formed by regions surrounded by intersections of data lines with scanning lines, where each pixel region includes a 2T pixel circuit, specifically, each pixel circuit includes a first transistor T1, a second transistor T2 and a light-emitting diode 204, a gate of the first transistor T1 is electrically connected to the scanning line Scan(n), wherein n is a natural number, a first electrode of the first transistor T1 is electrically connected to the data line Data(1), and a second electrode of the first transistor T1 is connected to a gate of the second transistor T2; a first electrode of the second transistor is connected to a data line Data(2), a second electrode of the second transistor is electrically connected to one end of the light-emitting diode 204, the other end of the light-emitting diode 204 is connected to a common ground terminal 207.

Further, the embodiment of the invention further includes a defect detection unit particularly an organic light-emitting diode 206, which is disposed at a first endpoint 205 of the scanning line Scan(n) and is electrically connected to the scanning line Scan(n), the first endpoint 205 is located at one end of a whole scanning line Scan(n), and in a preferred embodiment in FIG. 5, the organic light-emitting diode 206 is disposed at a first endpoint 205 of each scanning line, the other end of each organic light-emitting diode 206 is connected to the common ground terminal 207.

Since the defect detection unit is disposed as above, when some lateral periodic defects are analyzed, it is only required to carefully observe luminous intensity of the organic light-emitting diode 206 at each-stage VSR output in conjunction with a phenomenon, and take the luminous intensity for comparison.

If a reason of the periodic defect relates to a VSR output voltage, the organic light-emitting diode, i.e. the defect detection unit, will have a corresponding periodic phenomenon. Specifically, a defect detection method includes: providing an optical detection device at first; sending, by a scanning line, a detection signal to defect detection units corresponding to rows, where the defect detection unit may be an organic light-emitting diode; detecting, by the optical detection device, whether luminous intensity of the organic light-emitting diode corresponding to the scanning line of the pixel driving circuit reaches a valid predetermined value, where the predetermined value may be set as 4000 candelas, and determining that a data line or the scanning line corresponding to the organic light-emitting diode has a defect in a case that the organic light-emitting diode does not emit light or the luminous intensity is lower than the predetermined value. In the embodiment, detection time lasts no more than 60 seconds after the detection begins, and the predetermined value of the luminous intensity and the detection time may also be adjusted based on an actual product and a circuit structure.

Furthermore, the embodiment of the invention further provides a method for manufacturing an organic light-emitting diode. With reference to FIG. 3 and FIG. 4, the organic light-emitting diode includes: an anode 2 in the same layer as the stretched line metal in a scanning line and disposed on a substrate 1, where the anode 2 may be made of a metal material; a hole injection layer 3 on the anode 2; a light-emitting layer 4 made of an organic material; and a cathode covering the light-emitting layer which is finally fabricated, where the cathode may be made of a metal having a low power consumption, and the cathode of the organic light-emitting diode is connected to the common ground terminal. In a case that an electrical field is applied between the anode 2 and the cathode 5, holes in the hole injection layer 3 and electrons in the metal enter into the light-emitting layer 4, and are recombined with each other in the light-emitting layer 4, then an organic material (fluorescence and phosphorescence) in the light-emitting layer 4 is excited and transited to generate visible light. In this case, the brightness of the organic light-emitting diode is in direct proportion to a current between the anode and the cathode.

The structure of the pixel circuit and the structure of the organic light-emitting diode described above are just examples, a structure of a pixel circuit having multiple transistors and multiple capacitors in the art may also be suitable for the structure of the disclosure, and this also applies to the organic light-emitting diode. Only a simpler structure is recited in the embodiment of the invention, other structure of the organic light-emitting diode may also be applied to the disclosure.

An Embodiment

Figure 6:
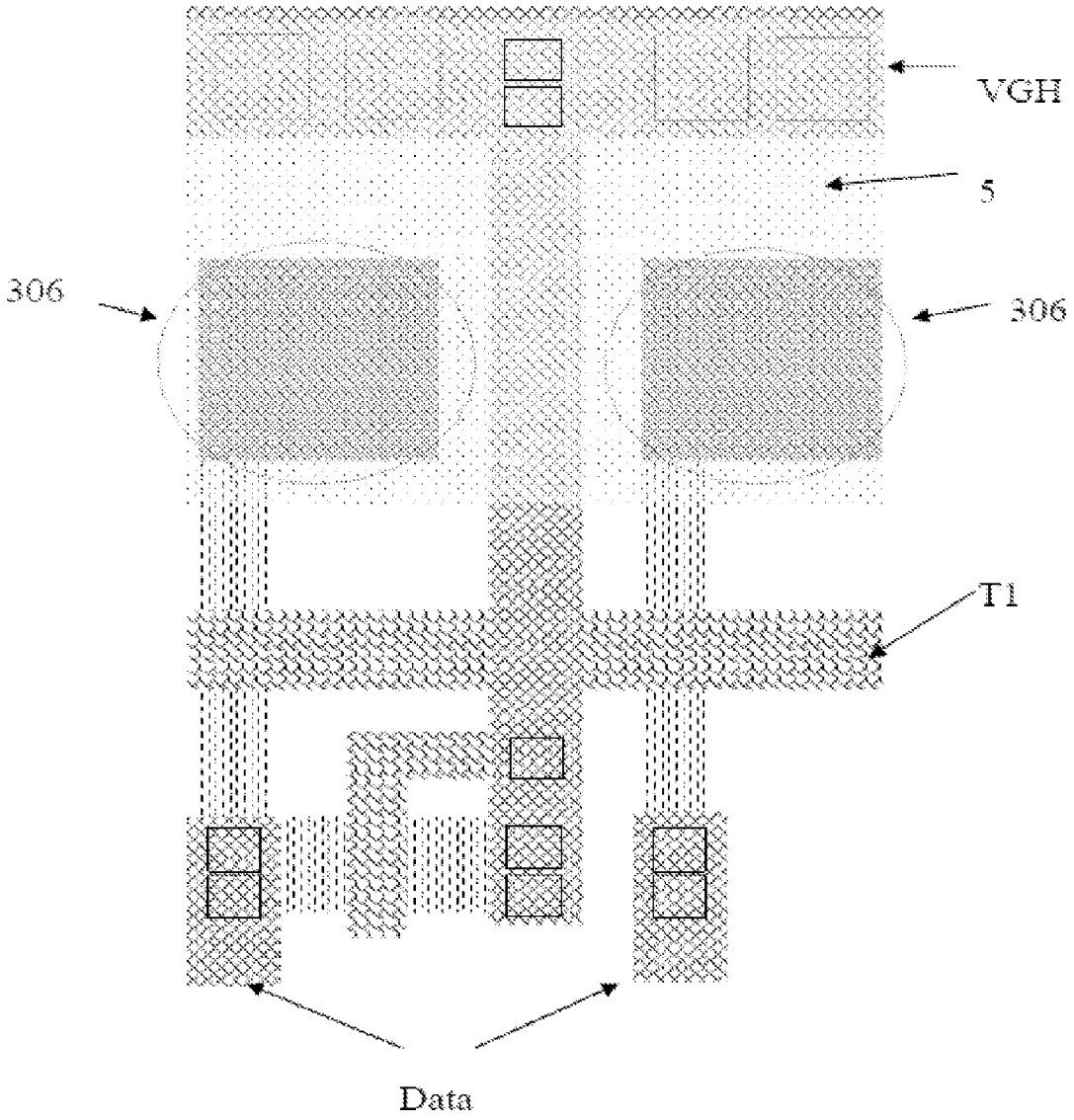
FIG. 6 is a diagram of a pixel structure according to another embodiment of the invention.
Figure 7:
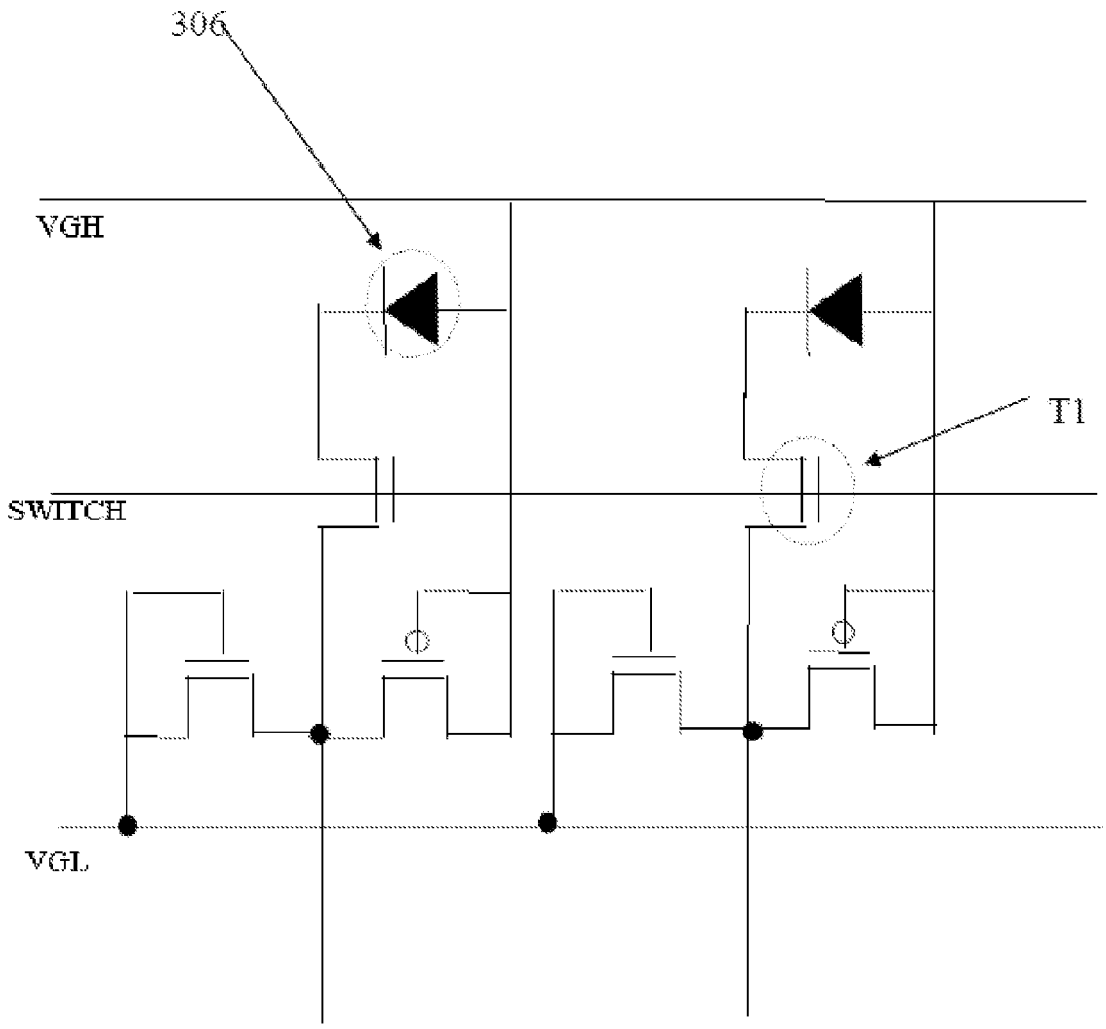
FIG. 7 is a diagram of a pixel circuit according to another embodiment of the invention.

As shown in FIG. 6 and FIG. 7 which is a schematic structural diagram of a pixel circuit according to an embodiment of the invention, an OLED pixel circuit includes an electrostatic protection circuit at an end of a data line. The electrostatic protection circuit includes: an electrostatic discharge unit configured to receive a voltage from a data line or a driving line of the pixel driving circuit and provide an electrostatic protection; a power source line VGH; a switch transistor T1; and an organic light-emitting diode 306 as a defect detection unit, where the organic light-emitting diode 306 is connected to a gate of the switch transistor T1 through the power supply line, the organic light-emitting diode 306 is connected to a first electrode of the switch transistor T1, and a second electrode of the switch transistor T1 is connected to a data line of the pixel driving circuit.

Generally, multiple electrostatic protection circuits are often designed on a display panel, in a case that a damage caused by static electricity occurs in a process of manufacturing a product, these electrostatic protection circuits have a certain protection ability; however, in an actual usage process, it is found that an abnormality of these circuits themselves will cause a new problem, for example, it is difficult to discover a defect caused by leakage current of a ESD circuit at an end of the data line. A reason for this kind of defect is found eventually through a long-term analysis and an expensive EMMI detection.

By the structure of the embodiment of the invention, an organic light-emitting diode unit is added into an electrostatic protection part at the end of the data line, in this way, in a case that some line defects such as a bright line or a thin bright line for the data line are analyzed, it is only required to observe carefully luminous intensity of the organic light-emitting diode at an end output of the electrostatic protection in conjunction with an appropriate detection screen such as applying the same voltage of the data line for all columns, and then take the luminous intensity for comparison. If a cause of the line defect relates to an output voltage, the organic light-emitting diode, i.e. the defect detection unit, will have a corresponding phenomenon.

Specifically, a defect detection method includes: providing an optical detection device at first; sending, by a data line, a detection signal to a defect detection unit corresponding to rows, where the line defect detection unit may be an organic light-emitting diode; detecting, by the optical detection device, whether luminous intensity of the organic light-emitting diode corresponding to the electrostatic protection circuit reaches a valid predetermined value, where the predetermined value may be set as 4000 candelas, and determining that the data line corresponding to the organic light-emitting diode has a defect in a case that the organic light-emitting diode does not emit light or the luminous intensity is lower than the predetermined value. In the embodiment, detection time lasts no more than 60 seconds after the detection begins, and the predetermined value of the luminous intensity and the detection time may also be adjusted based on an actual product and a circuit structure.

Furthermore, the embodiment of the invention further provides a method for manufacturing an organic light-emitting diode. With reference to FIG. 3 and FIG. 6, the organic light-emitting diode includes: an anode 2 in the same layer as the stretched line metal in a data line and disposed on a substrate 1, where the anode 2 may be made of a metal material; a hole injection layer 3 on the anode 2; a light-emitting layer 4 made of an organic material; and a cathode 5 covering the light-emitting layer which is finally fabricated, where the cathode may be made of a metal having a low power consumption, and the cathode of the organic light-emitting diode is connected to the common ground terminal. In a case that an electrical field is applied between the anode 2 and the cathode 5, holes in the hole injection layer 3 and electrons in the metal enter into the light-emitting layer 4, and are recombined with each other in the light-emitting layer 4, then an organic material (fluorescence and phosphorescence) in the light-emitting layer 4 is excited and transited to generate visible light. In this case, the brightness of the organic light-emitting diode is in direct proportion to a current between the anode and the cathode.

The structure of the pixel circuit and the structure of the organic light-emitting diode described above are just examples, a structure of a pixel circuit having multiple transistors and multiple capacitors in the art may also be suitable for the structure of the disclosure, and this also applies to the organic light-emitting. Only a simpler structure is recited in the embodiment of the invention, other structure of the organic light-emitting diode may also be applied to the disclosure.

The disclosure further provides a display panel, including: a scanning driver connected to several scanning lines at second endpoints of the scanning lines (the second endpoint is located at an end other than the first endpoint) and configured to provide a scanning signal; a data driver connected to several data lines at second endpoints of the data lines and configured to provide a data signal; and multiple pixel driving circuits, which may be any one kind of pixel driving circuit as described above, arranged in a matrix fashion, where the second endpoint of the data line or the scanning line is located at an end of the data line or the scanning line other than the end of the data line or the scanning line where a first endpoints located.

The foregoing are only preferred embodiments of the invention and therefore are not intended to limit the invention. Any changes, equivalent alternates and modifications and so on made within the spirit and principle of the invention will be included in the scope of the protection of the invention.

What is claimed is:

1. An organic light-emitting diode (OLED) pixel driving circuit, comprising:

a plurality of interlaced scanning and data lines; and a first defect detection unit electrically connected to a first endpoint of at least one of:

a) the scanning lines, and b) the data lines, wherein the first endpoint is located at one end of the at least one scanning line or data line, the first defect detection unit comprises an organic light-emitting diode for detecting a defect in the at least one scanning line or data line, and the organic light-emitting diode comprises an anode disposed in the same layer as the data line or the scanning line and disposed on a substrate; an organic light-emitting layer covering the anode; and a cathode covering the organic light-emitting layer, wherein the cathode of the organic light-emitting diode is connected to a common ground terminal.

2. The pixel driving circuit according to claim 1, wherein each data line is electrically connected to the first defect detection unit.

3. The pixel driving circuit according to claim 1, wherein each scanning line is electrically connected to the first defect detection unit.

4. The pixel driving circuit according to claim 1, further comprising:

an electrostatic discharge protection circuit disposed at the first endpoint of the data line or the scanning line; and a second defect detection unit disposed in the electrostatic discharge protection circuit.

5. The pixel driving circuit according to claim 4, wherein the electrostatic discharge protection circuit further comprises:

an electrostatic discharge unit configured to receive a voltage from the data line or the scanning line of the pixel driving circuit and to provide an electrostatic protection, a power supply line, and a switch transistor, wherein the second defect detection unit is connected to a gate of the switch transistor through the power supply line, wherein the second defect detection unit is connected to a first electrode of the switch transistor, and wherein a second electrode of the switch transistor is connected to the data line or the scanning line of the pixel driving circuit.

6. The pixel driving circuit according to claim 5, wherein the second defect detection unit is an organic light-emitting diode having an anode connected to the gate of the switch transistor and a cathode connected to the first electrode of the switch transistor.

7. A display panel, comprising:

a scanning driver connected to a plurality of scanning lines at second endpoints of the scanning lines and configured to provide a scanning signal to the scanning lines;

a data driver connected to a plurality of data lines at second endpoints of the data lines and configured to provide a data signal to the data lines; and a plurality of pixel driving circuits arranged in a matrix, wherein the second endpoint of each data line or scanning line is located at one end of the data line or the scanning line, wherein the pixel driving circuits each comprises a first defect detection unit electrically connected to a first endpoint of at least one of:

a) the scanning lines, and b) the data lines, and wherein the first endpoint is located at another end of the at least one scanning line or data line, the first defect detection unit comprises an organic light-emitting diode for detecting a defect in the at least one scanning line or data line, and the organic light-emitting diode comprises an anode disposed in the same layer as the data line or the scanning line and disposed on a substrate; an organic light-emitting layer covering the anode; and a cathode covering the organic light-emitting layer, wherein the cathode of the organic light-emitting diode is connected to a common ground terminal.

8. The display panel according to claim 7, wherein each data line is electrically connected to the first defect detection unit.

9. The display panel according to claim 7, wherein each scanning line is electrically connected to the first defect detection unit.

10. A method of detecting a defect a display panel, the display panel comprising a scanning driver connected to a plurality of scanning lines at second endpoints of the scanning lines and configured to provide a scanning signal to the scanning lines, a data driver connected to a plurality of data lines at second endpoints of the data lines and configured to provide a data signal to the data lines, and a plurality of pixel driving circuits arranged in a matrix, wherein the second endpoint of each data line or scanning line is located at one end of the data line or the scanning line, wherein the pixel driving circuits each comprises a first defect detection unit electrically connected to a first endpoint of at least one of the scanning lines, and the data lines, and the first endpoint is located at another end of the at least one scanning line or data line, wherein the first defect detection unit comprises an organic light-emitting diode for detecting a defect in the at least one scanning line or data line, and the organic light-emitting diode comprises an anode disposed in the same layer as the data line or the scanning line and disposed on a substrate; an organic light-emitting layer covering the anode; and a cathode covering the organic light-emitting layer, and wherein the cathode of the organic light-emitting diode is connected to a common ground terminal, the method comprising:

providing an optical detection device;

at least one of:

a) sending, by a scanning line, a detection signal to a defect detection unit corresponding to rows, and b) sending, by a data line, a detection signal to a defect detection unit corresponding to columns, wherein the defect detection unit comprises an organic light-emitting diode;

detecting, by the optical detection device, whether luminous intensity of the organic light-emitting diode corresponding to the data line and/or the scanning line of a pixel driving circuit reaches a valid predetermined value; and determining that the data line or the scanning line corresponding to the organic light-emitting diode has a defect in response to the organic light-emitting diode having a luminous intensity less than the predetermined value.

11. The defect detection method according to claim 10, wherein detection time lasts no more than 60 seconds after the detection begins.

12. The defect detection method according to claim 10, wherein a predetermined value of the luminous intensity is set as approximately 4000 candelas.

* * * * *